United States Patent [19]

Sullivan

[11] Patent Number: 4,773,197

[45] Date of Patent: Sep. 27, 1988

[54] AIR DUCT BOOT

[76] Inventor: John F. Sullivan, 12513 Greenlea Chase West, Oklahoma City, Okla. 73170

[21] Appl. No.: 63,528

[22] Filed: Jun. 18, 1987

[51] Int. Cl.[4] ..... E04G 5/48

[52] U.S. Cl. ..... 52/221; 98/102

[58] Field of Search ..... 52/34, 221; 98/102; 285/189, 158, 56, 64

[56] References Cited

U.S. PATENT DOCUMENTS

| | | | |
|---|---|---|---|
| 380,145 | 3/1888 | Springer | 98/102 X |
| 2,297,179 | 9/1942 | Walker | 72/16 |
| 2,335,906 | 12/1943 | Blinn | 72/16 |
| 3,676,568 | 7/1972 | Fork | 52/221 X |
| 3,815,214 | 6/1974 | Kyle, Jr. | 285/189 X |
| 4,261,598 | 4/1981 | Cornwall | 285/56 |
| 4,499,332 | 2/1985 | Shea | 174/48 |
| 4,619,471 | 10/1986 | Harbeke | 185/158 |
| 4,623,170 | 11/1986 | Cornwall | 52/221 X |

FOREIGN PATENT DOCUMENTS

| | | | |
|---|---|---|---|
| 217119 | 11/1967 | Sweden | 52/221 |

*Primary Examiner*—Carl D. Friedman

*Attorney, Agent, or Firm*—Laney, Dougherty, Hessin & Beavers

[57] ABSTRACT

An air duct boot useful for connecting a heating and air conditioning duct to an air register grate to permit air to be circulated into a space to be heated or cooled. The air duct boot includes a housing of right parallelepiped configuration constructed of a synthetic resin. The housing includes an integrally molded top or upper portion which can be quickly and easily removed after the boot is installed in a concrete pad or other foundation structure. A protuberant, generally cylindrical neck portion extends from one side of the housing near its lower end for connection to the duct. The entire air duct boot is molded as an integral unit.

8 Claims, 1 Drawing Sheet

AIR DUCT BOOT

FIELD OF THE INVENTION

This invention relates to fittings used in the ducting of central heating and air conditioning systems, and more particularly, to an air duct boot utilized to terminate ducting in an air register located at the air discharge location.

BRIEF DESCRIPTION OF THE PRIOR ART

In the construction of buildings which are to be provided with central heating and air conditioning, a network of ducts is extended from a central source of heat or cool air into the various rooms for discharging the heated or cooled air into the rooms. At the ground level, these ducts are frequently laid horizontally within or beneath a slab or pad from the central location where the cooling or heating of the air is developed. The ducts then terminate in short, vertically extending legs which end at the surface of the floor within the particular room where the air is to be discharged. In reaching this location, the short vertical leg of the duct, which may be referred to as a boot, ends at its upper terminus at approximately floor level in an opening surrounded by a round or rectangular portion of the material of which the duct is constructed. At this location, an air register or grate is fitted over or into the open upper end of the boot to prevent various objects from falling into the boot and air duct.

One type of air duct boot which has been utilized is a metallic (usually sheet metal) housing having an open lower end and an open upper end, with the lower end being disposed in the sand upon which the pad or slab for the building is laid.

Cornwall U.S. Pat. No. 4,623,170, discloses a synthetic resin coupling sleeve which can be positioned in a concrete slab or other foundation structure, and which facilitates the securement of a pipe into and through the concrete. The coupling is of cylindrical form and includes a plurality of concentric external rings which facilitate cutting the sleeve or coupling off at a desired location even with the top surface of the concrete which is to be poured. The coupling is open at both the lower end and the upper end.

GENERAL DESCRIPTION OF THE PRESENT INVENTION

The present invention is a synthetic resin air duct boot which is used for connecting an air duct laid in or beneath a slab for a building to a grill or air register by which air from the duct is circulated into a room or enclosed space. The air duct boot can be quickly, easily and relatively inexpensively manufactured, and provides certain advantages over the type of metallic structures which have been predominantly used for this air conveyance purpose in the past.

Broadly described, the air duct boot of the invention includes a housing which is of generally right parallelepiped configuration, and includes substantially horizontally extending bottom and top walls interconnected by side walls. A protuberant rib extends around the housing near the top wall, and defines a location at which a portion of the housing can be easily removed after the air duct boot has been placed in position, and a concrete slab or pad has been poured to a selected level adjacent the top of the boot housing. The interior of the housing is thus opened at that time, and an air register grill can be secured in place over the top of the housing in order to facilitate the passage of air into a room or confined space in accordance with conventional air conditioning and heating principles.

The housing has a generally cylindrical neck which projects outwardly therefrom in a horizontal direction. The cylindrical neck is molded integrally with the housing, and includes an outer annular flange portion which is adjacent an annular shoulder near the free outer end of the cylindrical neck. The annular flange portion and the adjacent annular shoulder form a situs for the location of an O-ring sealing element, or other suitable sealing gasket. The end of a tubular air duct can be pressed over the cylindrical neck of the duct boot, and the O-Ring or gasket will form a seal with the interior surface of the duct.

An important object of the invention is to provide an air duct boot which is an integrally molded synthetic resin unit having a closed bottom which prevents water from entering the boot from below after the boot is installed with its lower end located in the sand fill which underlies a building pad or slab in which the upper portion of the boot is positioned.

Another object of the invention is to provide an air duct boot which can be quickly and easily connected to a tubular air duct used to deliver hot or cool air in a central air conditioning and heating system, with such boot being provided at its upper end with an easily removable top portion which is dimensioned and configured to facilitate quick securement thereto of an air register grill.

A further object of the invention is to provide an air duct boot which is structurally strong and will retain its shape, even when the upper portion of the boot is initially surrounded by uncured concrete.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
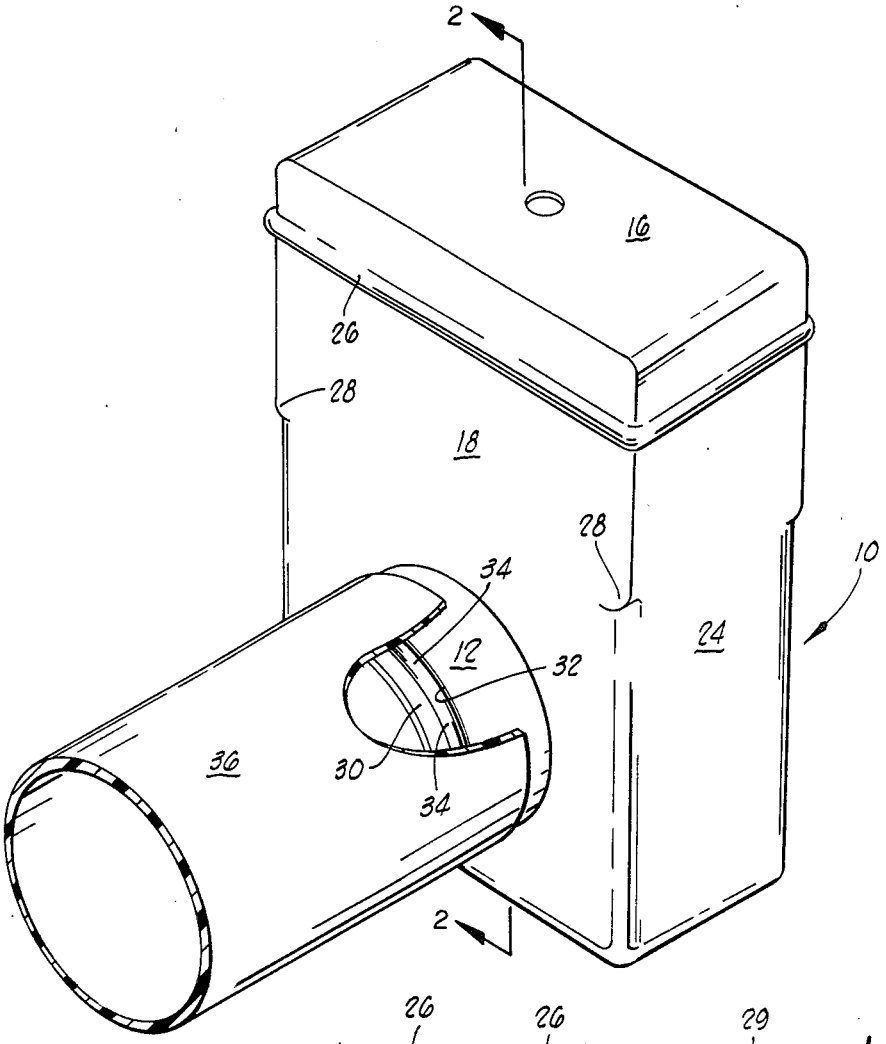
FIG. 1 is a perspective view of a preferred embodiment of the air duct boot of the invention.

Referring initially to the drawings, and particularly to FIG. 1, the air duct boot of the invention includes a housing 10 which has a generally cylindrical tubular neck 12 projecting from one side of the housing. The housing 10 is of generally right parallelepiped configuration, and includes a flat, substantially horizontally extending bottom wall 14 and a flat, substantially horizontally extending top wall 16 which extends parallel to the bottom wall. The housing further includes parallel front and back walls 18 and 20 respectively, and a pair of opposed narrow, parallel side walls 22 and 24. The side walls 22 and 24, of course, extend between and interconnect the bottom and top walls, 14 and 16, as do the front and back walls 18 and 20.

The housing 10 and the protuberant tubular neck or spout 12 constitute an integrally molded unit formed from a suitable synthetic resin material, such as polyvinylchloride. Blow molding is the preferred procedure for use in forming the duct boot. The generally cylindrical tubular neck 12 projects from the front wall 18 of the housing 10 and is spaced a relatively short distance above the bottom wall 14 toward the top wall 16.

Figure 2:
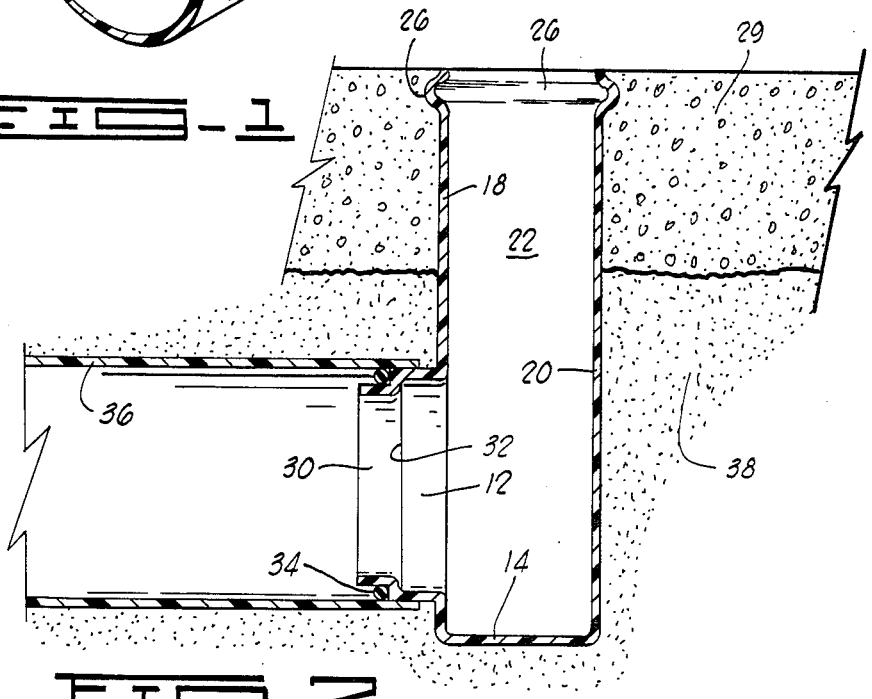
FIG. 2 is a sectional view taken along line 2—2 of FIG. 1, and illustrating, in addition to the section through the air duct boot and the air duct connected thereto, the surrounding fill sand and concrete slab or pad.

A protuberant generally semi-circularly cross-sectioned rib 26 is formed in the several side walls of the housing 10, and extends in a substantially horizontal plane projecting parallel to the bottom wall 14 and the top wall 16. The rib 26 is positioned a distance of from about ½" to about 3" downwardly from the top wall 16. At a location which is preferably between about ¼ and ¾ of the distance from the top wall 16 to the bottom wall 14 of the housing 10, a pair of slightly indented shoulders 28 are formed at the lateral edges of each of the two narrow side walls 22 and 24. This offset, resulting in the shoulders 28, aids in extricating the housing 10 from the mold, and also aids in positioning the housing in the material which surrounds at least a portion of it when it is located in its operative position in a building pad or slab 29, as illustrated in FIG. 2.

Formed on the axially outer free end of the tubular neck 12 is an annular, radially inset flange 30 which is joined to the neck by an annular, radially extending shoulder 32. The flange 30 and annular shoulder 32 function to form a seat for an annular, resilient O-ring or other type of gasket 34. The outer diameter of the gasket 34 is greater than the diameter of the tubular neck 12 so that the gasket will function to seal against the inner surface of a cylindrical or tubular duct section 36 which is pressed over the tubular neck 12 in the manner illustrated in the drawings.

In the use of the duct boot, it is first set at the location where it is intended to function as a riser extending from a horizontally projecting air duct section, upwardly to the surface of a floor within a room of a building to be heated or cooled. The duct boot is thus first connected to the open end of the duct section 36 by pressing the tubular neck 12 into the open end of the duct section. As the duct section 36 moves over the tubular neck 12, the gasket 34 is compressed and forms a high integrity seal between the flange 30 and the inner surface of the duct section 36. At this time, the duct boot is oriented in the manner illustrated in FIGS. 1 and 2 of the drawings, with the lower end portion of the housing 10, including the bottom wall 14, buried in the sand 38 which underlies the slab or pad 29 in the finished construction. At this time, of course, the sand 38 has not yet been filled completely to the level where the slab 29 will be poured, but FIG. 2 illustrates the final operative position of the duct section 36 and the housing 10 and the neck 12 carried thereon.

It will be noted that at this time, the bottom of the housing 10 is completely sealed against the ingress of any water which may seep up underneath the foundation of the structure built upon the slab—a not infrequent occurrence. Thus, water cannot enter into the system conveying warm or cool air, or to the interior of the house, nor can any type of insects or vermin enter into the air conditioning duct work by entering an open lower end of the duct boot. In being made of a chemically inert synthetic resin material, the duct boot resists rusting or oxidation to a state which may ultimately permit leakage of water into the lower end of the duct boot, and ingress thereinto by foreign matter or by insects.

After the duct boot has been connected to the free end of the duct section 36, filling of the sand around the interconnected duct and duct boot continues until the surface of the sand reaches the level where it is desired to pour the slab or pad 29. The housing 10 has been purposely dimensioned so that the housing will extend above the upper surface of the floor or slab after it is poured. This affords an adequate exposed amount of the housing to permit a portion of the housing to be cut away and a suitable air register grill to be fitted to the upper end of the housing 10. Preferably, the slab will be poured up to or slightly above the rib 26, as illustrated in FIG. 2.

The rib 26 functions as a delineater indicating to the construction crew a planar location which is approximately at the location of the level of the top of the slab, or the floor level within the building to be air conditioned. The rib 26 also functions as a reinforcing element which greatly enhances the strength of the upper portion of the housing 10, so that the housing can better withstand, without distortion, the compressive forces exerted on it as the concrete is poured to form the slab. The strength imparted to the upper portion of the housing 10 by the rib 26 also facilitates the cutting away of a portion of the housing above this rib after the slab has been poured, and for the purpose of making the housing terminate flush with the upper surface of the slab. The rib 26 also aids in preventing water leakage along the outside wall of the housing 10 and also aids in providing fire retardency.

After the upper portion of the housing 10 has been removed, an air register structure is secured to the free upper edge of the housing 10 in accordance with conventional securement techniques presently used in the art.

From the foregoing description of the invention, it will be perceived that the present invention provides an improved air duct boot which can be easily formed, is easily installed by virtue of being an integrally formed unit, has an extended service life by reason of having a closed bottom which prevents water from entering the air conditioning system, and which facilitates installation of an air register grill on the upper end thereof after the connection to the duct of the air conditioning system has been completed, and the slab has been poured.

Although the drawings and description which are here set forth function to describe, for illustrative purposes, the manner in which a preferred embodiment of the invention is to be constructed, it will be understood that various changes and innovations in the illustrated and described air duct boot structure can be effected by continuing to rely upon the the basic and fundamental principles upon which this invention is bottomed, and which are believed to be new. Changes and innovations of that type are deemed to be circumscribed by the spirit and scope of the invention, except as the same may be necessarily limited by the appended claims, or reasonable equivalents thereof.

What is claimed is:

1. An air duct boot for interconnecting, and extension between, a subfloor section of air conditioning and heating duct and an air register grill, said air duct boot comprising:

a synthetic resin tubular housing having an upper end and a lower end and having an integrally molded synthetic resin top wall closing the upper end of the housing, and an integrally molded synthetic resin bottom wall closing the lower end of the housing;

a tubular synthetic resin neck formed integrally with the housing and projecting horizontally outwardly from the side of the housing at a location relatively nearer the said bottom wall of the housing than to the top wall thereof; and a protuberant, semi-circular rib projecting outwardly from, and extending around, said housing in a plane extending parallel to said top wall, said rib being formed integrally with said housing.

2. An air duct boot as defined in claim 1 wherein said tubular neck is further characterized in having an inset annular flange on the outer free end thereof, and wherein said air duct boot further includes sealing means mounted around said inset annular flange.

3. An air duct boot as defined in claim 2 wherein said housing is of right parallelepiped configuration and said tubular neck is of cylindrical configuration.

4. An air duct boot as defined in claim 1 wherein said housing is of a right parallelepiped configuration and said tubular neck is of cylindrical configuration.

5. A system for conveying air from a source to a point of discharge comprising:

a bed of sand;

a concrete slab overlying the sand and having a level, horizontal upper surface;

a cylindrical, horizontally extending duct having an open end and overlain by the concrete in said slab; and a synthetic resin air duct boot connected to the open end of said duct and having a lower end portion in said sand, said air duct boot icluding:

a right parallelepiped hollow housing having a closed lower end buried in the sand and having a closed upper end above the upper surface of said concrete slab;

a protuberant rib projecting outwardly from said housing and extending around said housing at a location spaced downwardly from the closed upper end thereof; and a cylindrical tubular neck projecting horizontally outwardly from said housing at a location between said rib and the closed lower end of said housing, said tubular neck projecting into the open end of said duct to convey air from the interior of the duct to the interior of the housing; and sealing means between said tubular neck and said duct to prevent fluid leakage across the locus of joinder of the tubular neck and said duct.

6. A system for conveying air as defined in claim 5 wherein said tubular neck has an open free end spaced outwardly from said housing and located inside said duct, and wherein said air duct boot further includes a radially inset annular flange at the open free end of said tubular neck, and wherein said sealing means comprises a resilient O-ring seal around said inset flange and sealing against said flange and the interior of said duct.

7. A system for conveying air as defined in claim 5 wherein said protuberant rib is of semi-circular, cross-sectional configuration and lies in a plane extending parallel to the closed upper and lower ends of said housing.

8. A system for conveying air as defined in claim 7 wherein said neck has an open free end spaced outwardly from said housing and located inside said duct, and wherein said air duct boot further includes a radially inset annular flange at the open free end of said tubular neck, and wherein said sealing means comprises a resilient O-ring seal around said inset flange and sealing against said flange and the interior of said duct.

* * * * *